US009637855B2

(12) United States Patent
Buso et al.

(10) Patent No.: US 9,637,855 B2
(45) Date of Patent: May 2, 2017

(54) FRONT LOADING LAUNDRY MACHINE HAVING BELLOWS

(75) Inventors: Danny Buso, San Quirino (IT); Daniele Favaro, Pramaggiore (IT)

(73) Assignee: Electrolux Home Products Corporation N.V., Brussels (BE)

( * ) Notice: Subject to any disclaimer, the term of this patent is extended or adjusted under 35 U.S.C. 154(b) by 585 days.

(21) Appl. No.: 13/884,764

(22) PCT Filed: Oct. 19, 2011

(86) PCT No.: PCT/EP2011/068273
§ 371 (c)(1),
(2), (4) Date: Nov. 18, 2013

(87) PCT Pub. No.: WO2012/065801
PCT Pub. Date: May 24, 2012

(65) Prior Publication Data

US 2014/0060122 A1 Mar. 6, 2014

(30) Foreign Application Priority Data

Nov. 15, 2010 (EP) ..... 10191183

(51) Int. Cl.
*D06F 37/26* (2006.01)
*D06F 39/14* (2006.01)

(52) U.S. Cl.
CPC ..... *D06F 37/267* (2013.01); *D06F 37/266* (2013.01); *D06F 39/14* (2013.01)

(58) Field of Classification Search
CPC ..... D06F 37/267; D06F 37/266; D06F 39/14
See application file for complete search history.

(56) References Cited

U.S. PATENT DOCUMENTS 3,407,633 A * 10/1968 Giambertoni ..... 68/18 F
7,571,626 B2 * 8/2009 Choi ..... D06F 39/10 68/196

(Continued)

FOREIGN PATENT DOCUMENTS

CN 201193288 Y 2/2009
DE 198 56 973 6/1999

(Continued)

OTHER PUBLICATIONS

International Search Report issued in corresponding International Application No. PCT/EP2011/068273, dated Feb. 10, 2012.

(Continued)

*Primary Examiner* — Joseph L Perrin
(74) *Attorney, Agent, or Firm* — Banner & Witcoff, Ltd.

(57) ABSTRACT

A laundry machine includes a cabinet with a front panel having a laundry loading/unloading opening, and a door. A washing tub is accommodated within the cabinet. A drum is rotatably arranged within the washing tub in such a way that a frontal rim of the drum faces the laundry loading/unloading opening, and a bellows connecting a rim of the laundry loading/unloading opening to the opening of the washing tub. The bellows includes a first and a second lip protruding towards the rotation axis of the drum wherein the first and second lips are each placed to hinder the passage of foreign bodies from the drum to the washing tub through a gap between the drum and the washing tub. The frontal rim of the drum is located between the first and the second lips.

14 Claims, 6 Drawing Sheets

(56) References Cited

U.S. PATENT DOCUMENTS

| | | | | |
|---|---|---|---|---|
| 7,958,756 | B2 * | 6/2011 | Gracia Bobed | D06F 37/266 68/139 |
| 8,109,121 | B2 * | 2/2012 | Shin | D06F 35/00 68/196 |
| 2004/0148978 | A1 * | 8/2004 | Kim | D06F 37/267 68/23 A |
| 2004/0163426 | A1 | 8/2004 | Kim et al. | |
| 2006/0174663 | A1 * | 8/2006 | Cimetta | D06F 37/266 68/3 R |
| 2007/0051142 | A1 * | 3/2007 | Lim | D06F 37/266 68/139 |
| 2008/0120788 | A1 * | 5/2008 | Do et al. | 8/159 |
| 2009/0126418 | A1 * | 5/2009 | Shin et al. | 68/208 |

FOREIGN PATENT DOCUMENTS

| | | |
|---|---|---|
| DE | 103 60 564 | 7/2005 |
| DE | 10 2006 031352 | 1/2008 |
| EP | 1 321 559 | 6/2003 |
| EP | 1 690 969 | 8/2006 |
| EP | 1 881 101 | 1/2008 |
| EP | 2 078 777 | 7/2009 |
| GB | 1 309 363 | 3/1973 |

OTHER PUBLICATIONS

CN Appln 201180055017.1, First Office Action, dated Feb. 4, 2015 (English Translation).
CN Appln 201180055017.1, Second Office Action, dated Sep. 7, 2015 (English Translation).

* cited by examiner

FRONT LOADING LAUNDRY MACHINE HAVING BELLOWS

BACKGROUND

Embodiments of the present invention relates to laundry machines, particularly laundry washing machines and laundry washers/dryers. More specifically, embodiments of the present invention relates to front-loading laundry machines.

A front-loading washing machine typically comprises a casing or cabinet provided with a loading opening for loading and unloading the laundry in/from a drum rotatably arranged within a washing tub having an opening in correspondence of the loading opening formed in the cabinet, and a door is hinged to the cabinet for closing the loading opening. A bellows is mounted to the rim of the loading opening and to the corresponding opening formed in the tub for providing a fluid-tight sealing for the loading opening once the door is closed, in order to avoid any water leakage from the washing machine during operation.

In operation, water is caused to partially fill the washing tub, and the drum is caused to rotate at variable speeds, depending on the phases of the washing cycle, which, in the spinning phase may reach 800-1,600 rpm. This high speed rotation along with the tumbling of the laundry within the rotating drum may cause foreign bodies, forgot in the laundry being washed (i.e., keys, coins, etc.) to be expelled from the laundry into the drum; from the drum, the foreign bodies may then pass into the washing tub through an interspace existing between the drum and the tub adjacent the loading opening. The foreign bodies that may happen to fall into the washing tub may then be dragged into the draining circuit of the washing machine where they may clog and/or damage the drain pump.

This problem is typically avoided by providing the draining circuit with an anti-clog filter placed upstream the drain pump. Such anti-clog filter has to be periodically removed and cleaned from any foreign body and from the fluff. For this purpose, an access port is usually provided in a lower portion of a front panel of the machine cabinet allowing access to and removal of the anti-clog filter from its housing for maintenance/cleaning by a user. Unfortunately, the access port is placed in an uncomfortable position, making the filter removal and/or cleaning an annoying task.

Moreover, an amount of waste washing/rinsing liquid remains upstream the drain pump and flow back into the filter, thus requiring the user to empty the filter from it. The emptying operation is typically allowed by means of an exhaust tube located in a lower frontal portion of the laundry machine. As the exhaust tube is opened, waste washing liquid pours therefrom onto the ground surrounding the machine and, due to the low and uncomfortable position of the exhaust tube, collecting such remaining waste washing liquid in a container is very difficult.

These problems quite often induce the user to neglect the proper care of the anti-clog filter, with the consequently risk of washing machine malfunction.

In addition, the anti-clog filter access port reduces the aesthetic quality of the machine, breaking its integrity, and the provision of the access port for extracting the filter has a considerable weight on the overall costs of the laundry machine. This is for example the case of the solution disclosed in EP1881101, relating to a domestic washing machine, of both the front-loading and top-loading type, comprising a filter compartment and an associated closing cap, and a small front panel on the inside of which the compartment is formed, wherein the cap is provided with a through-hole which can be closed by a respective small lid, the hole being arranged in a projecting position with respect to the cap and the small front panel and being arranged in a position substantially at the bottom of the cap, when the latter is closed. Moreover the cap is provided with a raised central grip and the hole is arranged on the central grip.

In the art, several solutions have been proposed for solving the above mentioned problems.

DE 19856973 discloses a washing machine drum structure that has an inner drum to take the washing within an outer drum. A seal with a folded section is at the opening of the outer drum to absorb vibrations. A protective wall prevents foreign bodies being flushed between the drums. A projection is at one side of the protective wall to prevent a foreign body being flushed out and from penetrating into the space between the drums.

Unfortunately, this solution has a major drawback: the laundry being washed may be trapped between the protective wall and the inner drum. When this occurs, the laundry may be damaged by frictional forces or may clog the washing machine.

DE 10360564 describes a washing machine with an inner drum rotated during the wash and spin cycles of the machine program and small items which may spill through an opening between the drum front and the door seal are prevented from being lost by a wall on the outer tank front plate and on the door seal.

According to this solution, if small items are able to trespass the wall there are no other means to prevent such small items from reaching the drain pump. Moreover, the configuration of this solution facilitates an accumulation of water in the door seal.

GB1309363 discloses a washing machine with a flexible bellows interconnecting apertures in an outer housing and an inner housing through which laundry is loaded into a rotatable drum with a horizontal axis. A pump for discharging liquid from the drum and a tubular member are provided, the latter containing a filter element through which liquid passes on its way from the housing to the pump and which may be withdrawn for cleaning through an aperture in the bellows when the door is opened. The tubular member has an intermediate connection with the inner housing and an elongated member with a handle is provided in the member for withdrawing the filter element.

In this solution, if the bellows, during the washing machine lifetime, loses at least part of its flexibility, the laundry could be able to enter into the tubular member when the machine is in operation, causing a malfunction thereof.

The aim of embodiments of the present invention is to provide a cost-effective improved laundry machine in which the probability of occurrence of laundry machine malfunctions is reduced, thus, at least partially, solving the prior-art drawbacks.

Another aim of embodiments of the present invention is to provide a laundry machine in which the maintenance of the anti-clog filter is simple.

Another aim of embodiments of the present invention is to provide a laundry machine in which the risk that foreign bodies, expelled from the laundry being washed, enter the washing machine tub is reduced.

SUMMARY OF SELECTED INVENTIVE ASPECTS

One aspect of the present invention relates to a laundry machine, particularly of the front loading type. The laundry machine comprises a cabinet with a front panel having a laundry loading/unloading opening, and a door for closing the laundry loading/unloading opening. A washing tub is accommodated within the cabinet and has an opening corresponding to the laundry loading/unloading opening. A drum is rotatably arranged within the washing tub in such a way that a frontal rim of the drum faces the laundry loading/unloading opening, and a bellows connects a rim of the laundry loading/unloading opening to the opening of the washing tub. The bellows comprises a first and a second lip protruding towards the rotation axis of said drum. The first lip is closer to the front panel than the second lip and is adapted to hinder the passage of foreign bodies from the drum to the washing tub through a gap between the drum and the washing tub. Said second lip is adapted to hinder the passage through said gap of foreign bodies possibly trespassing said first lip. Said frontal rim of said drum is located between the first and the second lips. In the solution according to an embodiment of the invention said first lip comprises a first lip end having a distance from said rotation axis greater than the distance of the frontal rim of said drum from said rotation axis, so that said first lip end is close to, but spaced apart from said frontal rim.

Preferred features of the method are set forth in the dependent claims.

The first and second lips may be formed from a resilient material.

The second lip may be bent towards the first lip.

The first and second lips may be annular in shape, each defining a circumference which center substantially corresponds to said rotation axis of said drum.

At least one channel may be formed in the lower portion of the bellows passing through the base of the first and second lips. Said at least one channel is adapted to fluidly connect an external region of the bellows located between the first lip and the front panel to the washing tub, in order to flow toward the washing tub the washing liquid that may accumulate in the bellows.

The bellows may further comprise a return duct adapted to flow washing water back from the bellows into the washing tub.

The bellows and said return duct may be made in a single piece construction.

The return duct may have an intake port formed in a lower portion of the bellows at the external bellows region.

The return duct may comprise a housing adapted to house an anti-clog filter.

The housing may be placed in proximity of said intake port.

The anti-clog filter may be removably accommodated within said filter housing.

The anti-clog filter may be non-removably associated to said return duct.

The anti-clog filter may be non-removably associated to said return duct in proximity of said intake port.

The anti-clog filter may be formed integral with the bellows.

BRIEF DESCRIPTION OF THE DRAWINGS

These, and others, features and advantages of the solution according to embodiments of the present invention will be better understood with reference to the following detailed description of some embodiments thereof, provided merely by way of exemplary and non-limitative purposes, to be read in conjunction with the attached drawings. In particular.

DETAILED DESCRIPTION OF EXAMPLE EMBODIMENTS

Figure 1A:
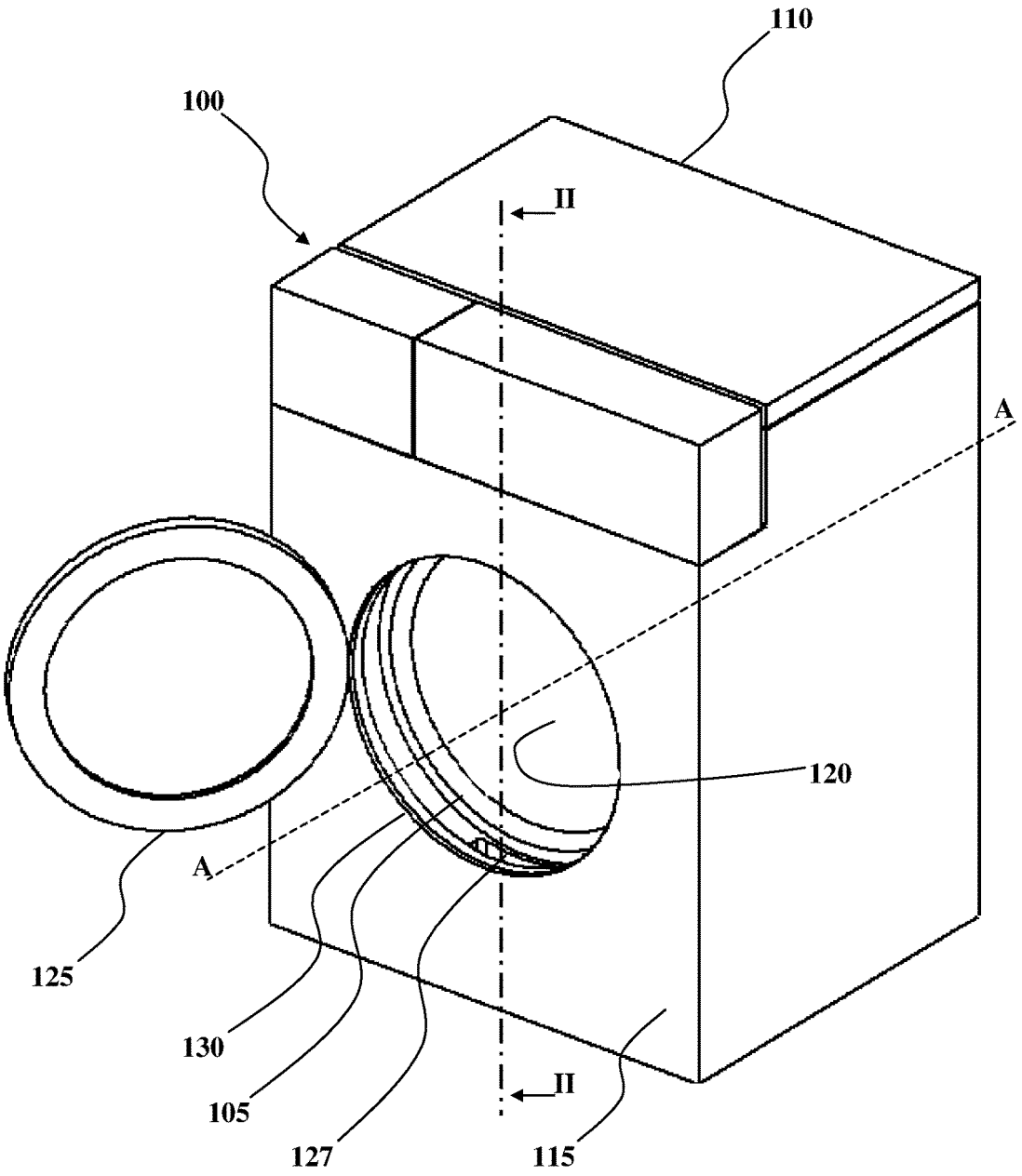
FIG. 1A shows a perspective view of a laundry machine, for example a laundry washer or washer/dryer, equipped with a bellows according to an embodiment of the present invention.
Figure 1B:
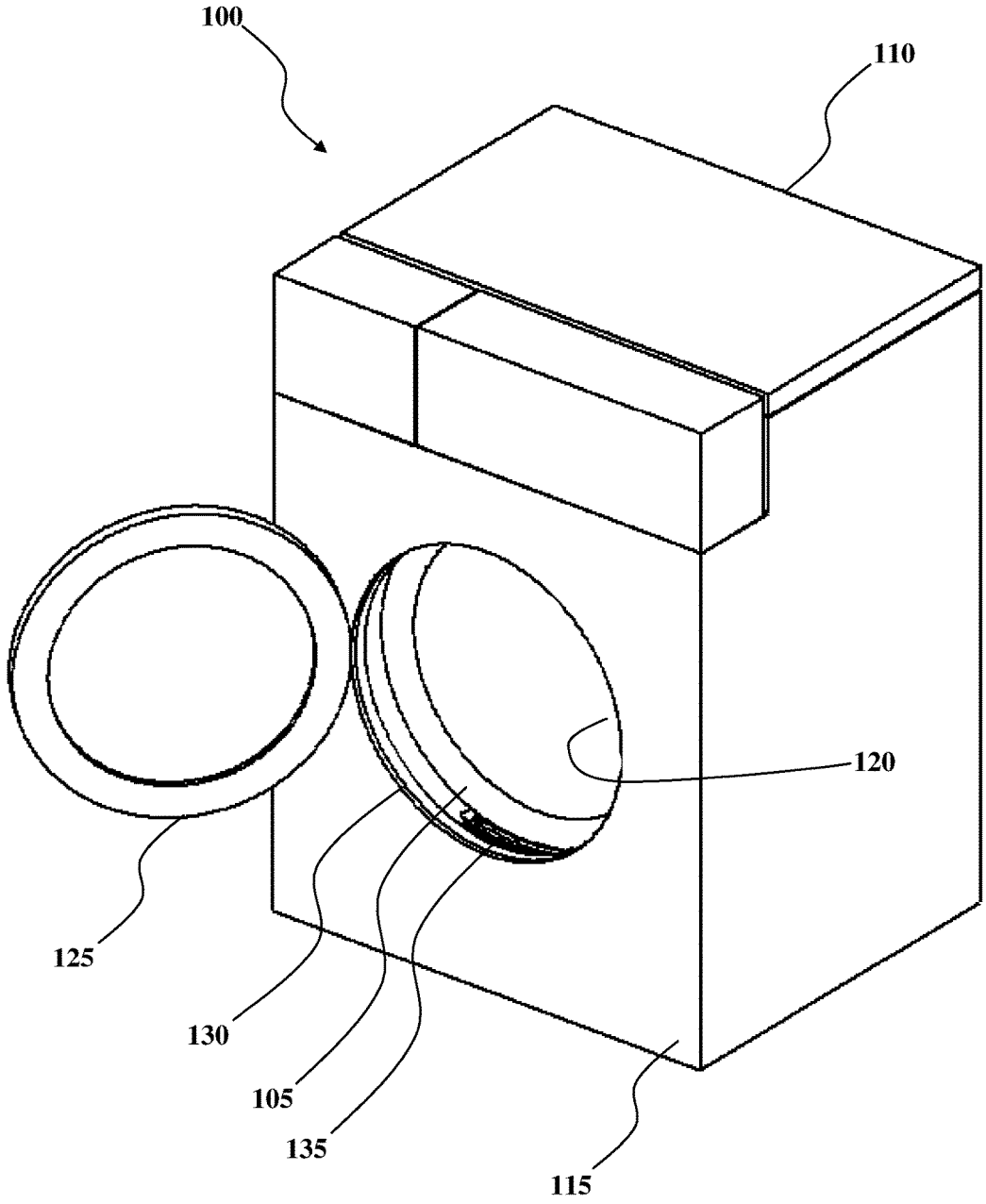
FIG. 1B is a view similar to that of FIG. 1A, but with a removable anti-clog filter placed in its seat in the bellows.

In FIGS. 1A and 1B a perspective view of a laundry machine 100 according to an embodiment of the present invention is shown, for example a laundry washer or washer/dryer. The laundry machine 100 comprises a casing or cabinet 110, preferably in a front panel 115 of which a loading opening 120 is provided, for loading and unloading the laundry to be washed and/or dried. A door 125 is provided, preferably hinged to the cabinet 110, for closing the loading opening 120 during laundry machine operation.

Figure 2:
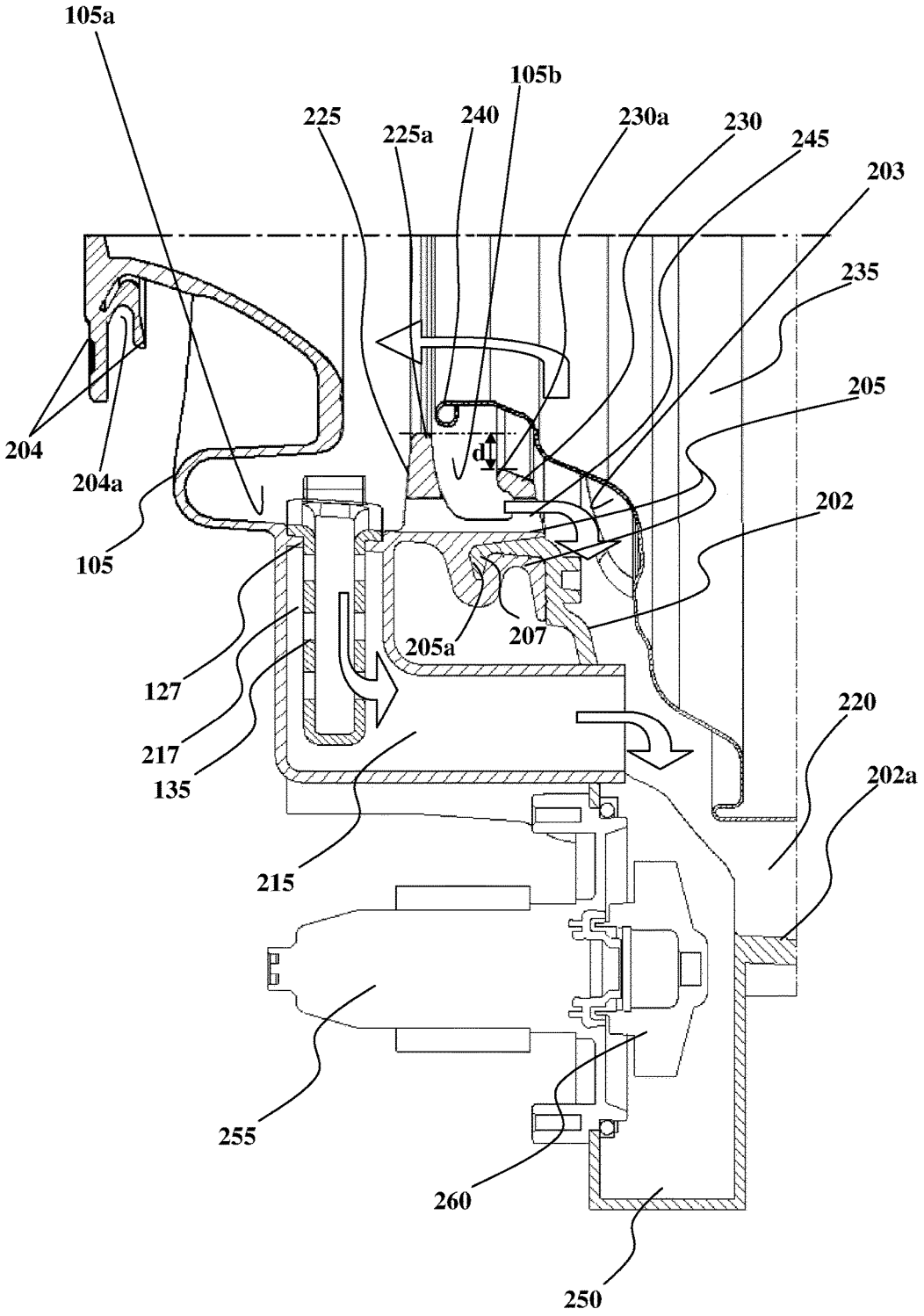
FIG. 2 is a cross-sectional side view along axis II-II showing a lower portion of a bellows according to an embodiment of the present invention mounted in position on a tub of a washing machine and accommodating the anti-clog filter.
Figure 3:
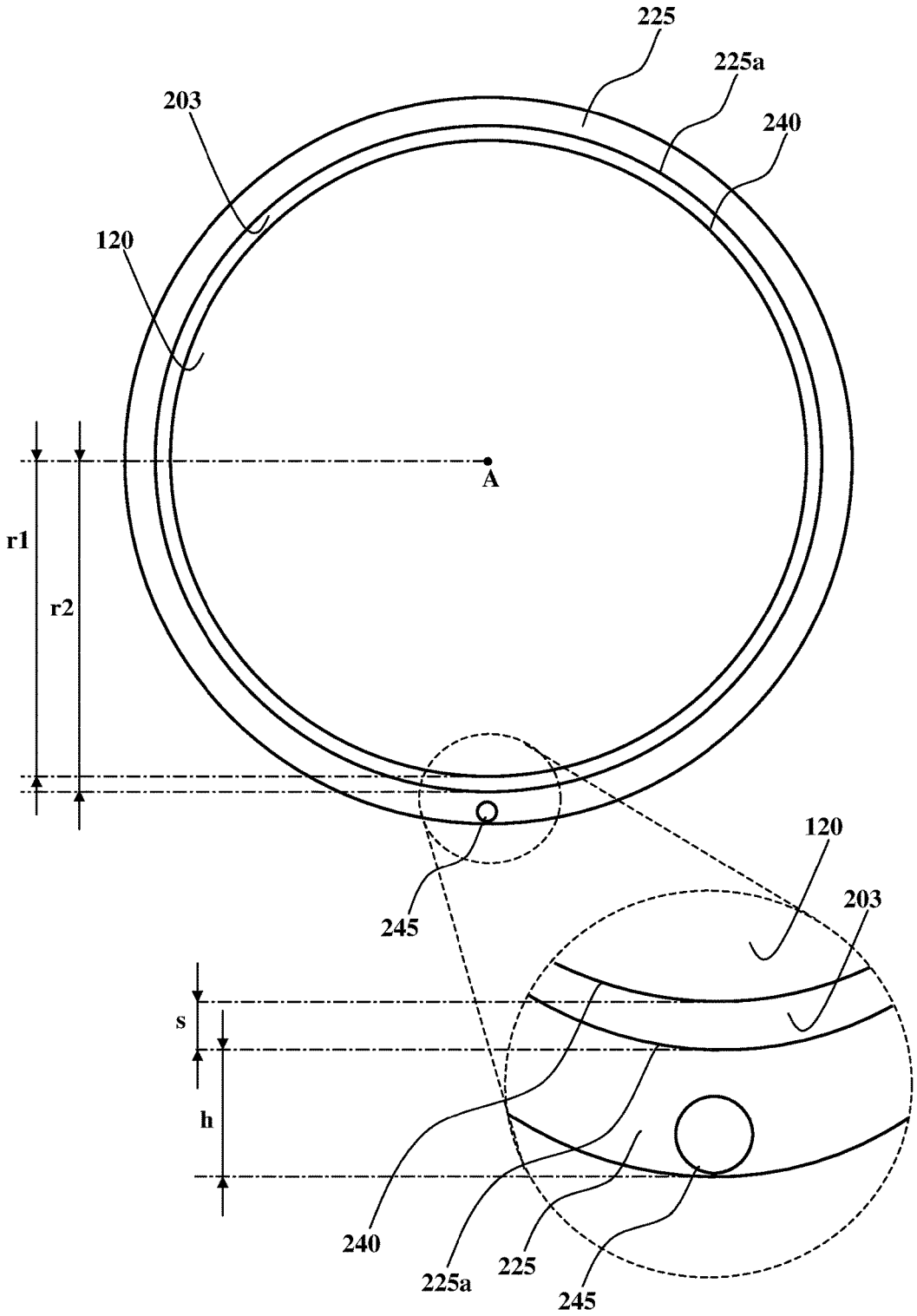
FIG. 3 is a simplified cross-sectional view transversal to the rotation axis A of a laundry drum.

Referring also to FIG. 2, a drum 235 is rotatably arranged within a washing tub 202 accommodated within the cabinet 110 so as to be rotatable about a rotation axis A (which position is showed in FIGS. 1 and 3). The washing tub 202 has an opening 203 in correspondence of the loading opening 120 formed in the cabinet 110. A bellows 105 is mounted to the rim of the loading opening 120 and to the corresponding opening formed in the washing tub 202 for providing a fluid-tight sealing for the loading opening 120 once the door 125 is closed, in order to avoid any washing liquid leakage from the laundry machine during operation.

According to an embodiment of the present invention, a return duct 215 is formed in the bellows 105, the return duct 215 having an intake port 127, preferably located in a lower portion of the bellows 105. During operation of the laundry machine, washing liquid that accumulates in the bellows 105 is drained by gravity through the intake port 127 into the return duct 215 and, from here, again into the washing tub 202, to be re-employed for washing the laundry or for being drained away at the end of a washing cycle (as will be described in the following).

Preferably, albeit not limitatively, the intake port 127 may be the opening of a filter housing 217 formed in the bellows 105 and adapted to accommodate an anti-clog filter 135, for example a removable anti-clog filter 135 that may be engaged, for example in a snap-fit fashion, to the intake port 127. Alternatively, the intake port 127 may be the entrance of an anti-clog filter 135 formed integrally (i.e. one piece) with, or may fixed in a non-removable fashion (e.g. via welding, heat sealing or screws) to the bellows 105, preferably inside the return duct 215.

The anti-clog filter 135 is designed to filter any foreign body that may be harmful for the laundry machine, from small lint and/or fluff particles lost by the laundry being washed/dried to bigger foreign bodies such as keys, coins, lighters, etc., that the user may forget in the laundry loaded in the drum.

Being placed in correspondence of the bellows 105, the anti-clog filter 135 is in a more ergonomic position and allows for a simpler inspection and maintenance thereof, consequently reducing the probability of a malfunction of the laundry machine 100 caused by a poor maintenance of the anti-clog filter 135.

Moreover, this location of the anti-clog filter 135 dispenses from the need of providing an access port on the front panel 115 of the laundry machine 100 for accessing and extracting the filter, thereby removing a constrain on the design of the laundry machine 100 and allowing to achieve a better aesthetic quality thereof. Additionally, the removal of the filter access port lowers the production costs of the laundry machine 100.

Anyway, it is pointed out that the anti-clog filter might be positioned elsewhere in the washing machine.

Turning now to FIG. 2, which is a cross-sectional side view along the axis II-II of FIG. 1A, there is shown a lower portion of the bellows 105 according to an embodiment of the present invention, mounted in position on the washing tub, denoted 202 in the drawing. The bellows 105 is preferably formed by a resilient material—e.g., a silicone-based compound—and is shaped so as to comprise a compressible folded portion (not numbered in figure) onto which the door 125 abuts when closed for sealing the loading opening; the bellows 105 also comprises a first attachment appendix 204, for example fork-shaped, for attaching the bellows to the loading opening periphery (for example, as shown in FIG. 2, the fork-shaped attaching element 204 defines a groove 204*a* which can be engaged by a portion of the rim of the loading opening 120), and a second attachment appendix 205, for example fork-shaped, for attaching the bellows 105 to a periphery 207 of the opening formed in the washing tub 202 (for example, as shown in FIG. 2, the fork-shaped attachment appendix 205 defines a groove 205*a* which can be engaged by the periphery 207 of the washing tub opening).

The bellows 105 is provided, at least in its lower portion (i.e. its bottom region), with a first, external lip 225 and a second, internal lip 230, that protrude from the bellows 105 toward the drum 235. Preferably, albeit not limitatively, both the first and the second lips 225 and 230 are annular in shape, each defining a circumference which center substantially corresponds to above mentioned rotation axis A of the drum 235. Further preferably, albeit not limitatively, both the first and the second lips 225 and 230 are formed integral, in one piece with the bellows 105 and made of the same resilient material. Preferably, the first lip 225 is flexible and is formed in a position adjacent but slightly displaced toward the machine front panel 115 with respect to a frontal rim 240 of the drum.

As visible in FIG. 3, schematically showing a cross-sectional frontal view of the first lip 225 and of the drum rim 240 on a plane transversal to the drum rotation axis A, the drum rim 240 defines a circumference which center substantially corresponds to above mentioned rotation axis A of the drum 235, and which radius is numbered r1 in FIG. 3. The distance of the end 225*a* of the first lip 225 from the axis A (numbered r2 in FIG. 3), is advantageously higher than radius r1; in the embodiment illustrated in the enclosed figures, in which the first and the second lips 225 and 230 are annular in shape, the end 225*a* of the first lip 225 lies on a circumference also centered on axis A and which radius corresponds to r2. Radius r1 is advantageously smaller than distance/radius r2.

In this way, a gap or spacing s exists between the first lip end 225*a* and the drum rim 240, such that the lip end 225*a* is close to, but slightly external to the drum rim 240, so as to avoid the risk that the lip end 225*a* comes into contact with the drum rim, in particular if the rotation shaft of the drum is bent towards the bottom of the machine due to the weight of the laundry, a thing that would cause wear of the bellows, especially when the drum rotates at high speed, as in the spinning phase.

Preferably, the spacing s between the first lip end 225*a* and the drum rim 240 is such as to prevent the passage of any foreign body (e.g., smaller than a coin) falling out from the drum 235, for example the spacing s ranges from 1.5 mm to 4 mm. The positioning of the first lip 225 also prevents that any laundry element (e.g., napkins, sockets, sweater sleeves, etc.) could be pinned between the drum rim 240 and the first lip 225 during the operation of the laundry machine 100, so avoiding the laundry to be damaged by friction during the rotation of the drum 235 and, at the same time, avoiding the drum 235 to be clogged by pinned laundry.

Moreover, (considering also FIG. 5) if occurs that a laundry element, being washed is spun against the first lip 225, the latter may be bent by the laundry element weight; nevertheless, such occurrence is not harmful for the laundry machine due to the spacing s that prevents the first lip end 225*a* contacting the drum 235 or its rim 240.

Figure 4:
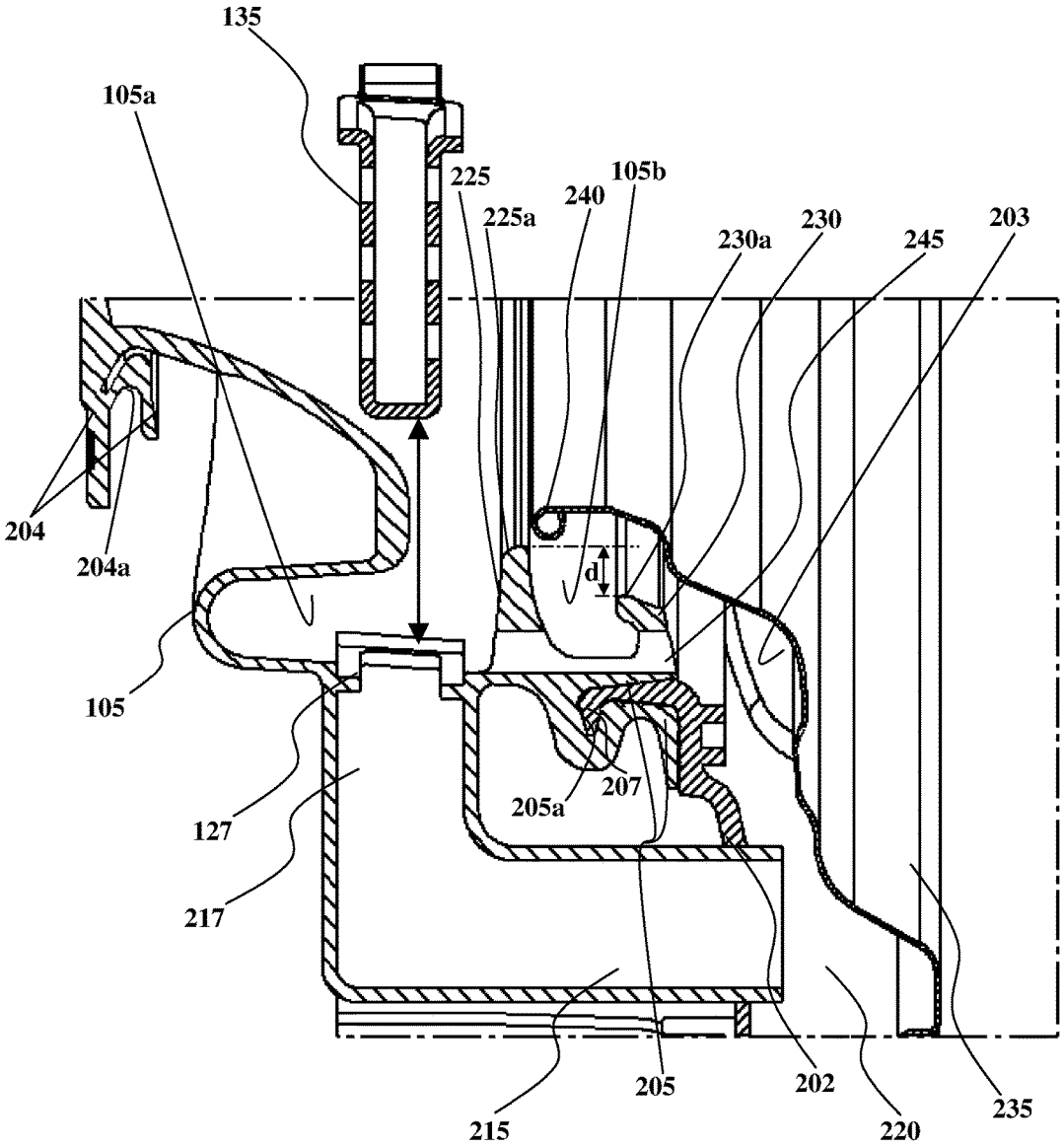
FIG. 4 is a cross-sectional side view along axis II-II showing, as FIG. 2. the lower portion of the bellows, but with the anti-clog filter removed from its seat.

Referring now to FIGS. 2 and 4, the second lip 230 is spaced apart from the first lip towards the rear of the machine, and protrudes from the bellows 105 in a position external to the drum 235, for example in correspondence of the attachment appendix 205. Preferably, albeit not limitatively, the second lip 230 is bent so that a lip end 230*a* is displaced, with respect to the second lip 230 base, towards the machine front panel 115. Preferably, between the second lip end 230*a* and the first lip end 225*a* there is a distance d (indicated in FIG. 4), for example equal to approximately half a height h of the first lip 230.

The first lip 225 defines two distinct annular regions of the bellows 105: an external region 105*a* and an internal region, or bellows region, 105*b* delimited by the first 225 and the second 230 lips; advantageously the intake port 127 is provided in the external region 105*a*.

Preferably, albeit not limitatively, one or more channels, like the channel 245 shown in the drawing, is/are formed in the lower portion of the bellows 105 passing through the base of the first and second lips 225 and 230; such channel(s) 245 allows to fluidly connect the external region 105*a* to the internal region 105*b* of the bellows 105, and the latter to the washing tub 202, in order to flow toward the washing tub 202 any excess water that in operation may happen to accumulate in the bellows 105, in this way preventing the drawbacks coming from a stagnation thereof. Advantageously, a cross-sectional area of the channel(s) 245 may be designed small enough to prevent any passage of foreign bodies.

The tub 202 is preferably, albeit not limitatively, substantially cylindrical-shaped. Advantageously, at a bottom 202*a* of the tub 202 a pump well 250 is formed, wherein a drain pump 255 is arranged. An impeller 260 of the drain pump 255 drains waste water from the washing tub 202 and flows it toward a sewer system via a drain tube (not shown in figure) during and at the end of a washing cycle for emptying the washing tub 202, and allowing removal of the washed laundry.

The improvements brought by the use of the bellows 105 according to the above-described embodiment of the invention will now be disclosed making reference to FIGS. 2-5. In operation, the door 125 is closed and abuts the bellows 105, and the compressible portion of the latter, due to is resilient nature, forms a fluid tight sealing around the periphery of the loading opening 120, preventing any washing liquid leakage from the laundry machine 100. The tumbling action and the spinning to which the laundry being washed is submitted in the rotating drum 235 may cause foreign bodies (e.g., keys, coins, lighters, etc., not shown in the figures), forgot in the laundry by the user, to be expelled from the laundry, in reason of their different weight. Particularly, the foreign bodies are usually expelled out of the drum 235 toward the door 125 of the laundry machine. There, the foreign bodies, due to their own weight, drop down into the lower portion of the bellows 105, particularly into the external region 105*a* thereof. Advantageously, the first lip 225 hinders the passage of the foreign bodies into the washing tub 202 through a gap between the drum 235 and the washing tub 202, and confines them in the external region 105*a* of the bellows 105, preventing them from passing in the interspace between the drum 235 and the washing tub 202. Foreign bodies in the bellows region 105*a* are, then, drained into the anti-clog filter 135, therefore becoming harmless for the drain pump 255 of the laundry machine 100. As mentioned above, the first lip end 225*a* is, preferably, arranged adjacent the drum rim 240 and not in contact the same, since there is the spacing s therebetween. Firstly, this prevents a wearing of the first lip 225 due to friction during the rotation of the drum 235, even if the rotation shaft of the drum is bent towards the bottom of the machine due to the weight of the laundry. Secondly, with this arrangement any laundry element (e.g., napkins, sockets, sweater sleeves, etc.) reaching the drum rim 240 cannot be pinned by the first lip 225 against the drum rim 240, a thing that, should it take place, would cause the laundry to be torn, damaged, or even cause a lock of the drum 235.

Figure 5:
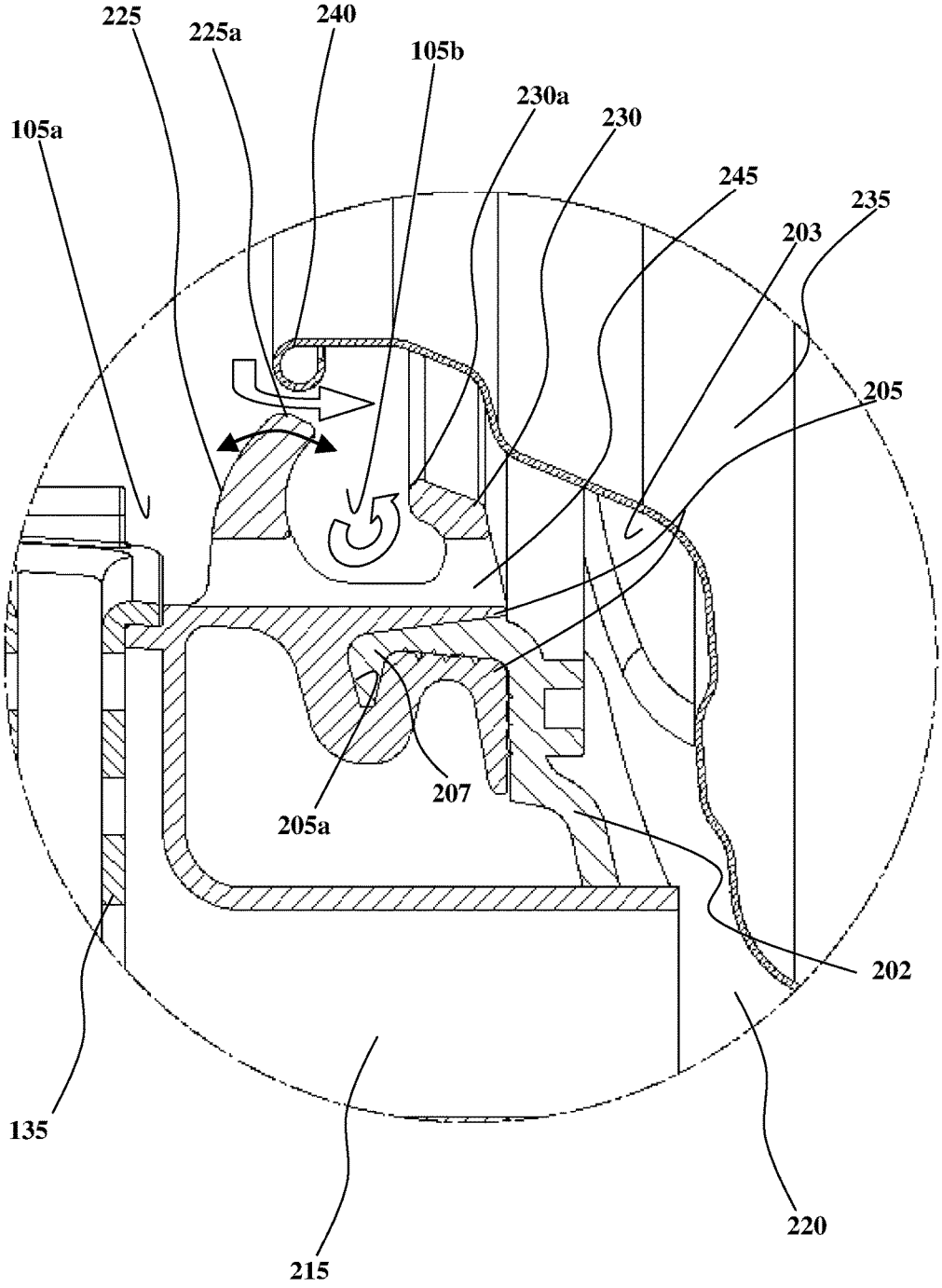
FIG. 5 is a cross-sectional side view along axis II-II showing a detail of lip region of the bellows according to an embodiment of the present invention, with an external lip thereof bent inward.

Should any foreign body, due to its weight, speed, or angle of incidence—or a combination thereof—cause the first lip 225 to bend inwardly, as depicted in FIG. 5, to such an extent as to allow the foreign body to pass over the first lip 225 and enter the bellows region 105*b*, the second lip 230 prevents such trespassing foreign body from reaching the washing tub 202 and subsequently clogging and/or damaging the drain pump: in other words, the outwardly bending second lip 230*a* helps to trap any foreign bodies in the bellows region 105*b*, from which the bodies can subsequently be removed. Moreover, the outwardly bending second lip end 230*a* may be formed in such a way as to help generating a whirlpool of water flowing throughout the lip region 105*b* turning in a counterclockwise (with reference to FIG. 5) direction that further helps to trap foreign bodies within the bellows region 105*a* during the laundry machine operation.

When the laundry machine is not working, after or before of the laundry removal from the drum 235, the user can easily access the bellows region 105*a* for removing (if removable, or for merely cleaning, if the filter 135 is not removable) the anti-clog filter 135 and checking if any foreign bodies have been stopped therein. Similarly, as depicted in FIG. 5, the user can easily check for the presence of foreign bodies in the bellows region 105*b* by simply pulling outward or pushing inward the first lip 225, for example, with a finger.

Naturally, in order to satisfy local and specific requirements, a person skilled in the art may apply to the solution described above many logical and/or physical modifications and alterations. More specifically, although this solution has been described with a certain degree of particularity with reference to one or more embodiments thereof, it should be understood that various omissions, substitutions and changes in the form and details as well as other embodiments are possible. Particularly, different embodiments of the invention may even be practiced without the specific details (such as the numerical examples) set forth in the preceding description to provide a more thorough understanding thereof; conversely, well-known features may have been omitted or simplified in order not to obscure the description with unnecessary particulars. Moreover, it is expressly intended that specific elements and/or method steps described in connection with any embodiment of the disclosed solution may be incorporated in any other embodiment as a matter of general design choice.

For example, although in the described embodiment the bellows is configured to accommodate the anti-clog filter, this is not to be construed limitatively for the present invention: the anti-clog filter may, in alternative embodiments, be located elsewhere.

The invention claimed is:

1. A front loading laundry machine comprising:

a cabinet with a front panel having a laundry loading/unloading opening, a door for closing the laundry loading/unloading opening, a washing tub accommodated within the cabinet and having an opening corresponding to the laundry loading/unloading opening, a drum rotatably arranged within the washing tub in such a way that a frontal rim of the drum faces the laundry loading/unloading opening, and a bellows connecting a rim of the laundry loading/unloading opening to the opening of the washing tub, wherein the bellows comprises a first and a second lip protruding towards the rotation axis of said drum, said first lip being closer to the front panel than the second lip and being adapted to hinder the passage of foreign bodies from the drum to the washing tub through a gap between the drum and the washing tub, said second lip being adapted to hinder the passage through said gap of foreign bodies possibly trespassing said first lip, said frontal rim of said drum being located between the first and the second lips, wherein:

said first lip comprises a first lip end having a distance from said rotation axis greater than the distance of the frontal rim of said drum from said rotation axis, so that said first lip end is close to, but spaced apart from said frontal rim, wherein the bellows comprise a return duct adapted to flow washing liquid from the bellows into the washing tub to avoid the washing liquid from accumulating in the bellows;

wherein the return duct has an intake port formed in a lower portion of the bellows at an external bellows region located between the first lip and the front panel to the washing tub;

wherein at least one channel is formed in the lower portion of the bellows passing through the base of the first and second lips, said at least one channel being adapted to fluidly connect an external region of the bellows located between the first lip and the front panel to the washing tub, in order to flow toward the washing tub the washing liquid that may accumulate in the bellows.

2. The laundry machine according to claim 1, wherein the first and second lips are formed from a resilient material.

3. The laundry machine according to claim 1, wherein the second lip is bent towards the first lip.

4. The laundry machine according to claim 1, wherein said first and second lips are annular in shape, each defining a circumference which center substantially corresponds to said rotation axis of said drum.

5. The laundry machine according to claim 1, wherein said bellows and said return duct are made in a single piece construction.

6. The laundry machine according to claim 1, wherein the return duct comprises a housing adapted to house an anti-clog filter.

7. The laundry machine according to claim 6, wherein the anti-clog filter is removably accommodated within said filter housing.

8. The laundry machine according to claim 1, wherein an anti-clog filter is non-removably associated to said return duct.

9. The laundry machine according to claim 8, wherein said anti-clog filter is non-removably associated to said return duct in proximity of said intake port.

10. The laundry machine according to claim 8, wherein said anti-clog filter is formed integral with the bellows.

11. The laundry machine according to claim 5, wherein the return duct comprises a housing adapted to house an anti-clog filter.

12. The laundry machine according to claim 6, wherein said housing is placed in proximity of said intake port.

13. The laundry machine according to claim 5, wherein an anti-clog filter is non-removably associated to said return duct.

14. The laundry machine according to claim 1 wherein the second lip has a height approximately half the height of the first lip.

* * * * *